US009800968B2

(12) United States Patent
Bogdanov et al.

(10) Patent No.: US 9,800,968 B2
(45) Date of Patent: Oct. 24, 2017

(54) LOW DIFFRACTION TWEETER HOUSING

(71) Applicant: Paradigm Electronics Inc., Mississauga (CA)

(72) Inventors: Oleg Bogdanov, Toronto (CA); Kevin Idzerda, Bolton (CA)

(73) Assignee: Paradigm Electronics Inc., Mississauga, Ontario (CA)

( * ) Notice: Subject to any disclaimer, the term of this patent is extended or adjusted under 35 U.S.C. 154(b) by 6 days.

(21) Appl. No.: 14/986,954

(22) Filed: Jan. 4, 2016

(65) Prior Publication Data

US 2016/0337749 A1 Nov. 17, 2016

Related U.S. Application Data

(60) Provisional application No. 62/160,993, filed on May 13, 2015.

(51) Int. Cl.

| | |
|---|---|
| ***H04R 1/24*** | (2006.01) |
| ***H04R 1/26*** | (2006.01) |
| ***H04R 1/28*** | (2006.01) |
| *H04R 1/02* | (2006.01) |
| *H04R 1/40* | (2006.01) |

(52) U.S. Cl.

CPC ..... *H04R 1/24* (2013.01); *H04R 1/2888* (2013.01); *H04R 1/023* (2013.01); *H04R 1/26* (2013.01); *H04R 1/403* (2013.01)

(58) Field of Classification Search

CPC ..... H04R 1/24; H04R 1/2888; H04R 1/26

See application file for complete search history.

(56) References Cited

U.S. PATENT DOCUMENTS

| | | | | | |
|---|---|---|---|---|---|
| 2,259,907 | A * | 10/1941 | Olney | H04R 1/24 | 381/186 |
| 2,857,478 | A * | 10/1958 | Harris | H04R 1/24 | 381/182 |
| 4,122,315 | A * | 10/1978 | Schroeder | H04R 1/24 | 181/147 |
| 4,554,414 | A * | 11/1985 | House | H04R 1/24 | 181/144 |
| 4,706,295 | A * | 11/1987 | Putnam | G10K 11/025 | 381/184 |
| 4,837,839 | A * | 6/1989 | Andrews | H04R 7/12 | 181/146 |
| 5,629,501 | A * | 5/1997 | Fenton | H04R 1/24 | 181/144 |
| 9,210,489 | B1 * | 12/2015 | Chu | H04R 1/24 | |
| 2008/0123877 | A1 * | 5/2008 | Rivera | H04R 1/24 | 381/184 |
| 2010/0124340 | A1 * | 5/2010 | Knieschewski | H04R 1/24 | 381/87 |
| 2011/0228966 | A1 * | 9/2011 | Varla | H04R 1/24 | 381/386 |

(Continued)

*Primary Examiner* — Matthew Eason

(74) *Attorney, Agent, or Firm* — Boyle Fredrickson S.C.

(57) ABSTRACT

The present invention discloses a high frequency transducer housing for use in a coaxial loudspeaker system to reduce diffraction. The coaxial loudspeaker system comprises at least one high frequency transducer that is arranged to be mounted with a second frequency transducer. The housing comprises a plurality of edges on a periphery of the housing. The edges of the housing have irregular shapes. The plurality of the edges are eccentric with a diaphragm of the second transducer.

15 Claims, 3 Drawing Sheets

(56) References Cited

U.S. PATENT DOCUMENTS

| | | | | |
|---|---|---|---|---|
| 2012/0148086 | A1* | 6/2012 | Tanabe | H04R 1/24 381/401 |
| 2012/0163637 | A1* | 6/2012 | Chen | H04R 1/24 381/184 |
| 2012/0224728 | A1* | 9/2012 | Chen | H04R 9/063 381/184 |
| 2013/0228393 | A1* | 9/2013 | Sterling | H04R 1/345 181/150 |
| 2014/0056436 | A1* | 2/2014 | Kim | H04R 1/24 381/71.7 |
| 2015/0341710 | A1* | 11/2015 | Gladwin | H04R 1/00 381/152 |
| 2016/0234590 | A1* | 8/2016 | Tomizawa | H04R 1/24 |

* cited by examiner

LOW DIFFRACTION TWEETER HOUSING

CROSS-REFERENCE TO RELATED APPLICATIONS

This application claims priority based on U.S. patent application Ser. No. 62/160,993 entitled "LOW DIFFRACTION TWEETER HOUSING" filed May 13, 2015, the subject matter of which is incorporated by reference herein in its entirety.

FIELD OF THE INVENTION

The invention relates to a housing of a loudspeaker, and in particular, a high frequency transducer housing ("tweeter housing") for use in a coaxial loudspeaker system.

BACKGROUND

Typically, a coaxial loudspeaker system consists of a high frequency transducer and one or more lower frequency transducers. The high frequency transducer can be mounted in front of or even within a lower frequency transducer.

Coaxial loudspeaker transducers make it possible to build 2 or 3 way loudspeaker system with smaller frontal area than conventional side by side transducers. The coaxial loudspeaker transducers also have an advantage of sound radiating from acoustically a single source for more even directivity pattern.

Disadvantage of the typical coaxial loudspeaker system is diffraction around the edges of the high frequency transducer housing. Diffraction of sound waves occurs when a sound wave encounter an obstacle that is comparable in size to the length of the sound wave. In a coaxial loudspeaker system, when a sound wave radiated from the diaphragm of a lower frequency transducer reaches the edge of high frequency transducer housing and is reflected by the edge of high frequency transducer housing, if the wavelength of the sound wave is comparable to the edge of the high frequency transducer housing, the reflected sound wave interferes with a subsequent sound wave with a similar wavelength propagating from the diaphragm of the lower frequency transducer. This interference between sound waves causes diffraction. The diffraction in turn causes irregular frequency response.

SUMMARY OF THE INVENTION

An objective of the present invention is to provide a high frequency transducer housing for a coaxial loudspeaker system to mitigate edge diffraction and to improve frequency response and sound radiation pattern of the sound waves radiated from a lower frequency transducer.

In an embodiment, there is provided a high frequency transducer housing for use in a coaxial loudspeaker system wherein at least one high frequency transducer is configured to be mounted with a second frequency transducer, the housing comprising:

a polygon having a plurality of sides;

a least one opening on the polygon for allowing sound waves radiated from the at least one high frequency loudspeaker pass through the housing; and at least one edge on a side of polygon, wherein the at least one edge is eccentric with a diaphragm of the second transducer.

In a further embodiment, there is provided a coaxial loudspeaker system, the coaxial loudspeaker system comprising at least one high frequency transducer that is configured to be mounted with a second frequency transducer, and a high frequency transducer housing for use in the coaxial loudspeaker system, the housing comprising:

a polygon having a plurality of sides;

a space on the polygon for allowing sound waves radiated from a high frequency loudspeaker pass through the housing; and at least one edge on a side of polygon, wherein the at least one edge is eccentric with a diaphragm of the second transducer.

DETAILED DESCRIPTION OF EMBODIMENTS

Particular embodiments of the present invention will now be described with reference to the drawings. It will be understood by the skilled reader, however, that various modifications to the embodiments described herein are possible. Such modifications are intended to fail within the scope of the present invention, which is described by the claims.

Figure 1:
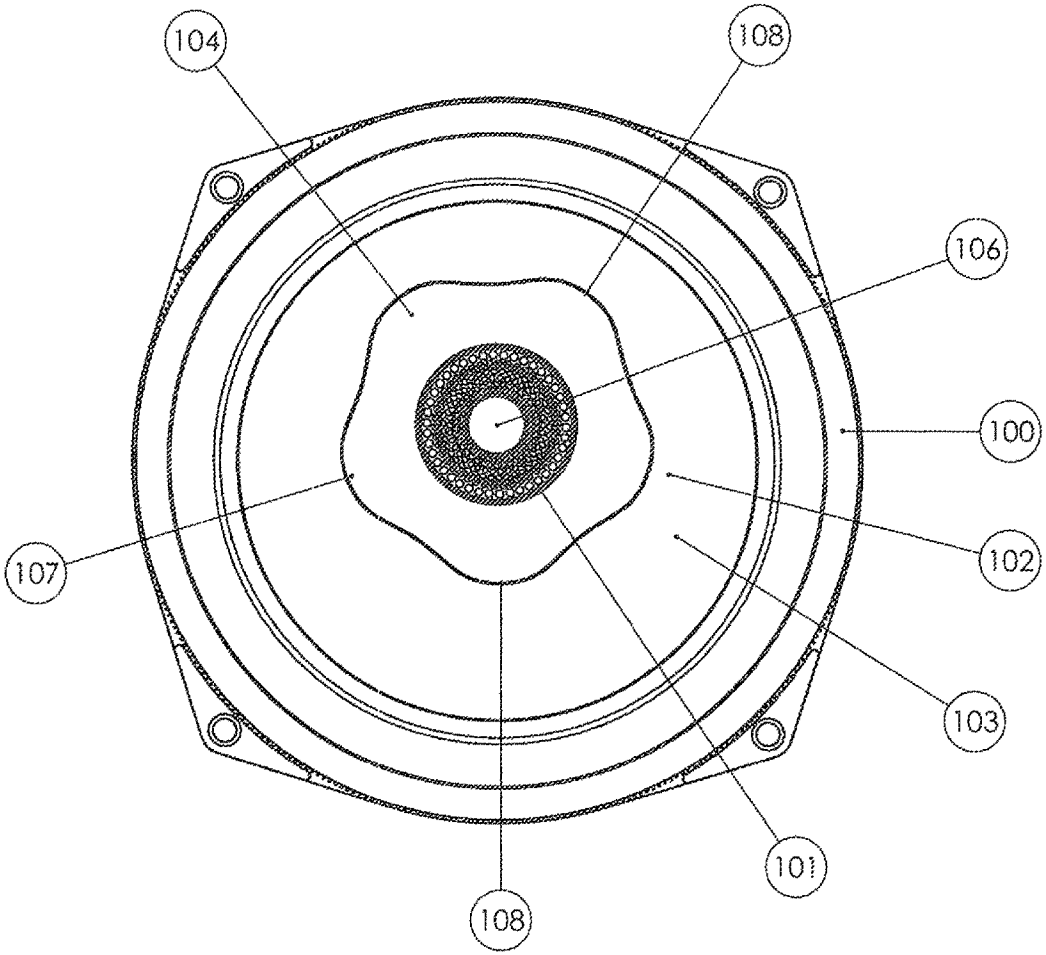
FIG. 1 is a front view of a coaxial loudspeaker system in which a high frequency transducer housing is in use with a high frequency transducer mounted coaxially in front of a lower frequency transducer according to an embodiment of the present application.

FIG. 1 illustrates a high frequency transducer housing for use in a coaxial loudspeaker system 100 according to an example of the present invention. The coaxial loudspeaker system 100 comprises a high frequency transducer 101 and a second frequency transducer 103. The second frequency transducer 103 may be a transducer having frequency lower than the frequency of the high frequency transducer. The high frequency transducer 101 is arranged coaxially with the second frequency transducer 103. The high frequency transducer 101 may be mounted in front of the second frequency transducer 103, or within the second frequency transducer 103. In the example of FIG. 1, the second frequency transducer 103 is a low frequency transducer and the high frequency transducer 101 is mounted in front of the low frequency transducer 103.

Figure 2:
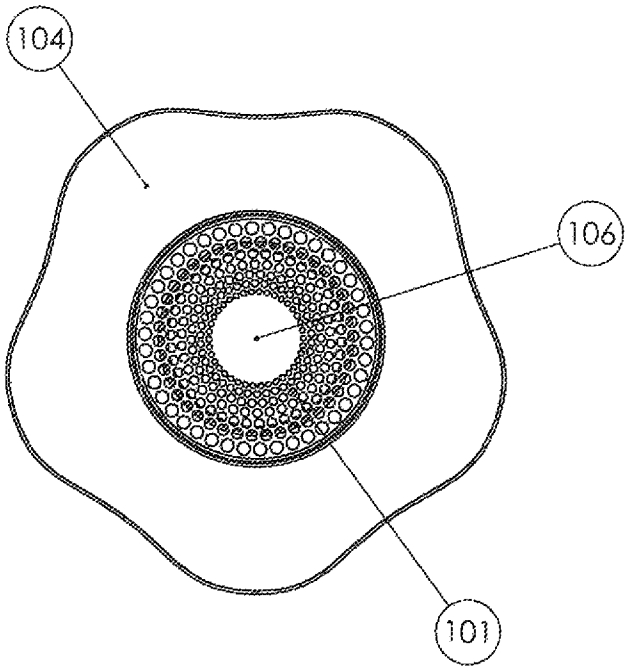
FIG. 2 is a front view of a high frequency transducer housing in use with a high frequency transducer according to FIG. 1.

In the example of FIG. 1, the high frequency transducer 101 is in use with a housing 104, a protective screen 106. In the example of FIG. 1, the diaphragm of the high frequency transducer is under the protective screen 106. The high frequency transducer 101 is mounted in front of and coaxially with the second frequency transducer 103. In the example of FIG. 2, the housing 104 is in use with the high frequency transducer 101, and a protective screen 106 may also be used in connection with the high frequency transducer 101.

As shown in FIGS. 1 and 2, the housing 104 comprises an outer surface 107 and a plurality of edges 108 on a generally polygonal-shaped outer periphery of the outer surface 107. The outer surface 107 generally is convex, but may also be concave, or a combination thereof. The housing 104 has an opening which allows sound waves from high frequency transducer 101 to pass. In FIG. 1, the space is substantially located at the centre of the housing 104.

The edges 108 of the housing 104 have irregular shapes. The edges are arranged to have substantially continuously varying distances from the centre of the diaphragm 102 of the second frequency transducer 103 to different points of the edges, so that reflection of the sound wave does not occur simultaneously, but is spread in time. This arrangement of the shapes of edges 108 reduces the effect of reflected wave superposition over direct wave and thus improves frequency response. The edges 108 of high frequency transducer housing 104 are eccentric with the diaphragm 102 of the low frequency transducer 103. The edges 108 may also be arranged asymmetrically to each other, for example, one edge of the housing 104 has no an opposing edge. The shape of the periphery of the outer surface 107 of the housing 104 may be a generally polygonal-shaped with substantially rounded edges 108. The edges 108 may be substantially concave or convex from the side of the outer surface 107. In the example of FIGS. 1 and 2, the housing 104 comprises an outer surface 107 in the shape of a pentagon and a plurality of undulations arranged along the periphery of the outer surface 107. Each side of the outer surface 107 has an edge 108 in FIGS. 1 and 2. The edges 108 in FIGS. 1 and 2 have roundly leading edges for smoothing reflection. Some sides of the outer surface 107 may not have any edge. Some sides of the outer surface 107 may have more than one edge.

Due to the irregular shape of the edges 108 of the housing 104, some of the sound waves propagating from the diaphragm 102 of the second frequency transducer 103 reach the edges 108 at different times. As a result, the sound waves reached the edges 108 are also reflected from the edges 108 at different times. These differences in times reduce the effect of diffraction and improves frequency response and sound radiation pattern.

Dimensions of the edges 108 are substantially comparable in size to a quarter of the wavelength of the sound wave that is affected by the diffraction. For example, if anomaly due to diffraction appears around 3 kHz, the quarter wavelength is about 2.86 centimeters, and dimensions of the edges 108 of the housing are substantially around 2.86 centimeters.

The number of the edges 108 depends on the size of the sides of the outer surface 107 of the high frequency transducer housing 104, and the wavelength of the sound wave that diffraction is required to be mitigated. The more sides the outer surface 107 of the housing 104 has, the more edges the housing 104 may have. If the size of a side of the outer surface 107 is big enough, the side of the outer surface 107 may have more than one rounded edges 108. As well, the high frequency transducer housing 104 may have more edges 108 if a sound affected by the diffraction has a shorter wavelength.

The numbers of the edges 108 can be determined after the shape of the housing 104, the size of the high frequency transducer housing 104, and the wavelength of the sound wave that is affected by the diffraction have been determined. The number of the edges 108 may be varied. On one hand, if the housing 104 has too few edges 108, the housing 104 will provide uneven directivity pattern; on the other hand, if the housing 104 has too many edges 108 so that the undulations become acoustically close to round edge baffle, the housing 104 will become less effective to reduce edge diffraction and to improve the frequency response and sound radiation pattern. Generally, odd number of edges 108 helps reduce addition of opposing edges reflections. For example, in FIG. 1, the number of the edges 108 is 5.

Figure 3:
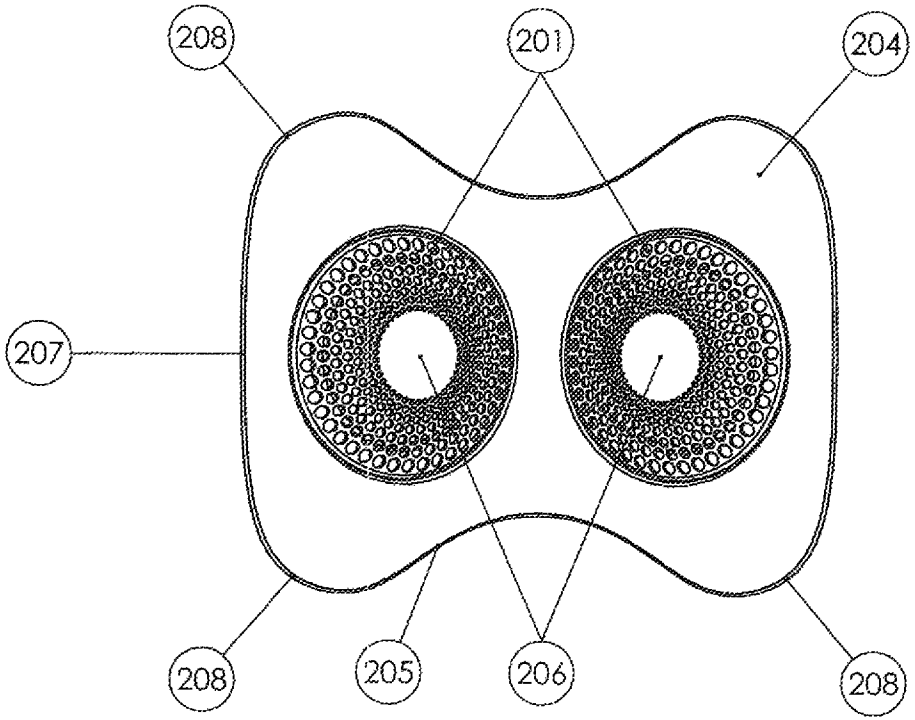
FIG. 3 is a front view of a tweeter housing in use with two high frequency transducers according to another embodiment of the present application.

In another embodiment according to FIG. 3, a tweeter housing 204 may be used in connection with two high frequency transducers 201. The housing 204 comprises two openings to fitly receive the two high frequency transducers 201. Each of the high frequency transducers 201 may have a perforated phase alignment tweeter screen 206 as shown in FIG. 3. In the example of FIG. 3, the polygon 207 of the housing is substantially rectangular, and four edges 208 are positioned at the two corners of each of the up and bottom sides 205.

The materials used to make the housing 104 may be metals that allow for adequate heat dissipation. For example, metals such as magnesium, aluminum, zinc, alloys thereof, etc. can be used to make the housing 104. The materials of the housing 104 may also be polymers. In the example of FIG. 1, the housing 104 is made of Aluminum and about 2.5 mm thick.

The scope of the claims should not be limited by the embodiments set forth in the examples, but should be given the broadest interpretation consistent with the specification as a whole.

We claim:

1. A high frequency transducer housing for use in a coaxial loudspeaker system wherein at least one high frequency transducer is arranged to be mounted with a second frequency transducer, the housing comprising:

an outer surface having a generally polygonal-shaped outer periphery formed from a plurality of edges; and at least one opening on the outer surface for allowing sound waves radiated from each of the at least one high frequency loudspeaker to pass through the housing; and wherein edges of the outer surface are eccentric with a diaphragm of the second transducer; and wherein the plurality of edges undulates along the polygonal-shaped outer periphery of the outer surface of the housing.

2. The high frequency transducer housing of claim 1, wherein the at least one edge is substantially rounded.

3. The high frequency transducer housing of claim 1, wherein the outer periphery of the housing has generally the shape of a pentagon shape.

4. The high frequency transducer housing of claim 1, wherein a dimension of at least one of the plurality of edges is substantially comparable in size to a quarter of a wavelength of a sound wave that is affected by diffraction.

5. The high frequency transducer housing of claim 1, wherein the number of the edges is an odd number.

6. The high frequency transducer housing of claim 1, wherein the number of the edges is 5.

7. The high frequency transducer housing of claim 1, wherein materials that comprise the housing are metals.

8. The high frequency transducer housing of claim 1, wherein materials that comprise the housing are polymers.

9. The high frequency transducer housing of claim 1, wherein the housing is configured to receive one high frequency transducer.

10. The high frequency transducer housing of claim 1, wherein the housing is configured to receive two high frequency transducers.

11. The high frequency transducer housing of claim 9, wherein the high frequency transducer is configured to be used with a perforated phase alignment tweeter screen.

12. A coaxial loudspeaker system comprising:

at least one high frequency transducer which is arranged to be mounted with a second frequency transducer; and a housing for the high frequency transducer, comprising:

an outer surface having a generally polygonal-shaped outer periphery formed from a plurality of edges; and a;

at least one opening defined by the polygon for allowing sound waves radiated from the at least one high frequency loudspeaker to pass through the housing, wherein at least one edge is eccentric with a diaphragm of the second transducer, and wherein the plurality of edges undulates along the polygonal-shaped outer periphery of the outer surface of the housing.

13. A high frequency transducer housing for use in a coaxial loudspeaker system wherein at least one high frequency transducer is arranged to be mounted with a second frequency transducer, the housing comprising:

an outer surface having a generally polygonal-shaped outer periphery formed from a plurality of edges; and at least one opening defined in the outer surface of the housing for allowing sound waves radiated from the at least one high frequency loudspeaker to pass through the housing, wherein the plurality of edges is eccentric with a diaphragm of the second transducer, and wherein a dimension of at least one of the plurality edges is substantially comparable in size to a quarter of a wavelength of a sound wave that is affected by diffraction.

14. A coaxial loudspeaker system comprising:

at least one high frequency transducer which is arranged to be mounted with a second frequency transducer; and a housing for the high frequency transducer, the housing comprising:

an outer surface having a generally polygonal-shaped outer periphery formed from a plurality of edges; and at least one opening defined in the outer surface of the housing for allowing sound waves radiated from the at least one high frequency loudspeaker to pass through the housing, wherein the plurality of edges is eccentric with a diaphragm of the second transducer, and wherein a dimension of one of the plurality edges is substantially comparable in size to a quarter of a wavelength of a sound wave that is affected by diffraction.

15. The high frequency transducer housing of claim 1, wherein the plurality of edges has irregular shapes so that reflection of sound waves on the edges is spread in time.

* * * * *